United States Patent [19]

Hughes

[11] 4,063,128

[45] Dec. 13, 1977

[54] CATHODE SUPPORT STRUCTURE FOR COLOR PICTURE TUBE GUNS TO EQUALIZE CUTOFF RELATION DURING WARM-UP

[75] Inventor: Richard Henry Hughes, Lancaster, Pa.

[73] Assignee: RCA Corporation, New York, N.Y.

[21] Appl. No.: 702,010

[22] Filed: July 2, 1976

[51] Int. Cl.[2] ..... H01J 29/02; H01J 29/50

[52] U.S. Cl. ..... 313/409; 313/447; 313/417

[58] Field of Search ..... 313/411, 409, 417, 414

[56] References Cited

U.S. PATENT DOCUMENTS

| | | | |
|---|---|---|---|
| 3,732,450 | 5/1973 | Mayers | 313/409 |
| 3,873,876 | 3/1975 | Yamauchi | 313/409 |
| 3,974,416 | 8/1976 | Goot et al. | 313/417 |

*Primary Examiner*—Robert Segal
*Attorney, Agent, or Firm*—E. M. Whitacre; G. H. Bruestle

[57] ABSTRACT

An in-line electron gun assembly for a color television picture tube has a center cathode disposed between two outer cathodes. The cathodes are substantially coplanar and each is supported at a predetermined distance from a control grid by a separate cathode support structure. Each cathode support structure includes a cathode eyelet. The center cathode eyelet is formed of a material having a smaller coefficient of thermal expansion than that of the two outer cathode eyelets so that the variations in carthode-to-grid spacing due to temperature changes during warm-up are kept substantially equal from cathode to cathode.

6 Claims, 3 Drawing Figures

CATHODE SUPPORT STRUCTURE FOR COLOR PICTURE TUBE GUNS TO EQUALIZE CUTOFF RELATION DURING WARM-UP

BACKGROUND OF THE INVENTION

This invention relates to electron gun assemblies and more particularly to electron gun assemblies of the type used in color television picture tubes.

In an in-line electron gun assembly having a structure comprising three separate cathodes, a control grid (also referred to as grid No. 1) spaced from the cathodes, and a screen grid (also referred to as grid No. 2) spaced from the control grid, separate bias voltages are applied to the cathodes. These bias voltages are adjusted to provide simultaneous cutoff of the beam currents for black level adjustment. Grid No. 1 is normally at zero volts and an adjusted value of grid No. 2 voltage is provided to establish the cathode cutoff bias voltages in a range of approximately 100 to 150 volts.

In a typical setup for operating the tube, video drive signals of the proper levels are applied to the cathodes so as to track from black level to all levels of standard white picture throughout the useful picture dynamic range. For quality tube operation, it is desirable that this cutoff setup of the three guns be kept in equal cutoff relation, one to the other, so that white picture tracking is maintained.

In the prior art, the desired equality of cutoff relationship has not been maintained during the warm-up period, which is usually considered to include approximately the first 15 minutes after the filament has been turned on. This inequality occurred because the cathode-to-grid No. 1 spacings of the three guns vary differently as the cathode and related structures are heated. Since the cathode-to-grid No. 1 spacing is considered to be the most important factor in establishing cutoff, there must be equality of expansion in time and magnitude if all three cathode-to-grid No. 1 spacings are to be maintained in unison.

SUMMARY OF THE INVENTION

In an electron gun assembly having at least two cathodes, each cathode is supported at a predetermined nominal spacing from a common control grid by a separate cathode support. Each cathode-to-control grid spacing varies as a function of temperature of the respective cathode support. One of the cathode supports stabilizes at a higher operating temperature than the other supports. The improvement comprises means for maintaining the temperature-dependent variations in the cathode-to-control grid spacings substantially equal from cathode to cathode.

DETAILED DESCRIPTION

Figure 1:
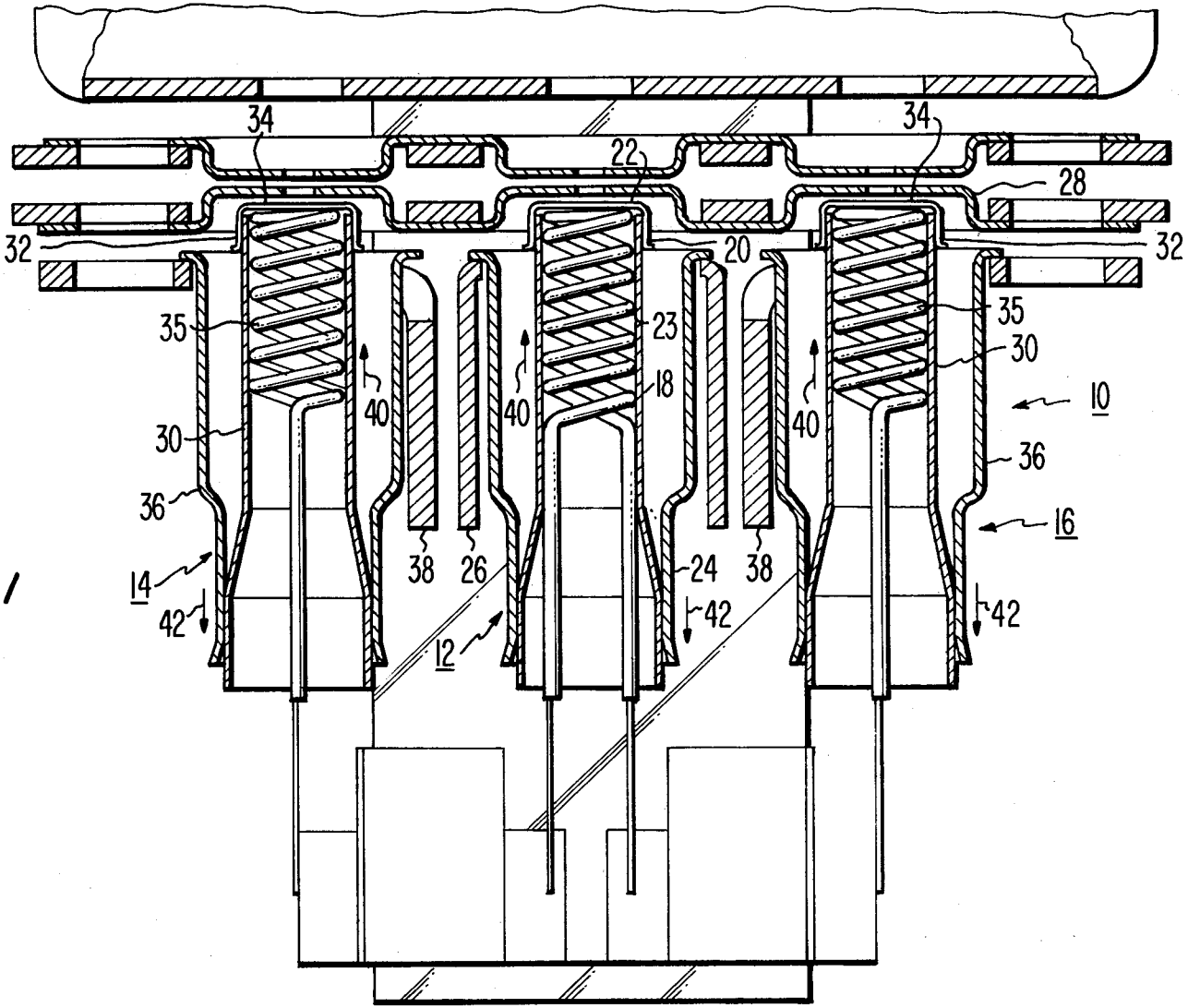
FIG. 1 is a sectional view of a portion of an in-line electron gun assembly.

In FIG. 1 there is shown a portion of an electron gun assembly 10 of a type used in color television picture tubes. Except for different materials used, the prior art electron gun assembly and the electron gun assembly featuring temperature compensation in accordance with the present invention utilize the same structure; consequently, the detailed description of the structure depicted in FIG. 1 is applicable to both.

The electron gun assembly 10 comprises a center cathode assembly 12, a first outer cathode assembly 14, and a second outer cathode assembly 16. The center cathode assembly 12 comprises a cathode sleeve 18 closed at the forward end by a cap 20 having an end coating 22 of an electron emissive material thereon. A filament 23 is mounted within the cathode sleeve 18. The electron emissive coating 22 is supported at a predetermined spacing from a No. 1 grid 28 (also referred to as the control grid) by a center cathode eyelet 24 which is attached to the cathode sleeve 18 as well as to a fixed center cathode support 26. This predetermined spacing is established during fabrication and is approximately equal to 0.13mm.

Similarly, the first and second outer cathode assemblies 14 and 16 each comprise a cathode sleeve 30 closed at the forward end by a cap 32 having an end coating 34 of an electron emissive material thereon. A filament 35 is mounted within each cathode sleeve 30. The electron emissive coatings 34 are each maintained at a predetermined spacing from the No. 1 grid 28 by a cathode eyelet 36 which is attached to the cathode sleeve 30 as well as to a fixed outer cathode support 38. The predetermined spacings of the outer cathode assemblies are also established during fabrication and are substantially equal to the spacing of the center cathode assembly, which is approximately 0.13mm.

Warm-up of Prior Art Guns

In prior art electron gun assemblies, all three cathode eyelets are made of the same material, usually an alloy of 52% nickel and 48% iron commonly known as 52 metal. This alloy has relatively low thermal expansion. The cathode support structures 26 and 38 are of unequal thickness, the outer support structures 38 being formed of 0.51mm thick material to provide structural rigidity while the center support structure 26 is formed of 0.25mm material to permit adequate spacing between the center and outer cathode assemblies. The thicker outer support structures 38 provide a better path for conducting heat away from the filaments than does the thinner center support structure 26. Consequently, when thermal equilibrium is achieved at approximately 15 minutes after filament turnon, the center cathode assembly 12 is operating at a higher temperature than the outer cathode assemblies 14 and 16. In other words, the temperature rise during warm-up is greater for the center cathode assembly 12 than for the outer cathode assemblies 14 and 16.

As a result of the temperature rise during warm-up, the cathode sleeves 18 and 30 expand toward the control grid 28, in the direction indicated by the arrows 40, while the cathode eyelets 24 and 36 expand away from the control grid 28 in the direction indicated by the arrows 42. This expansion of the cathode sleeves and eyelets and the unequal rise in temperatures causes the spacings between the cathodes and the control grid to change from the substantially equal spacings which were initially established during fabrication.

Due to their relatively thin walls, close proximity to the filaments and good thermal isolation from the remainder of the gun assembly, the cathode sleeves 18 and 30 achieve thermal equilibrium in a relatively short period of time, usually within 30 seconds after filament turn on for the structures shown in FIG. 1. As a result, thermal expansion of the sleeves after this time is minimal. Consequently, after approximately the first minute of warm-up, the major cause of changes in the spacings between the cathodes and the control grid is due to the expansion of the cathode eyelets 24 and 36.

As previously stated, the cathode-to-control grid spacing is generally considered to be the most important factor in establishing cutoff. Recognizing that variation in the cathode-to-control grid spacings occur during warm-up, the cutoff bias voltages are usually not established until operating temperature equilibrium has been attained, which occurs at least 5 and preferably 15 minutes after filament turn on. These bias voltages are adjusted to compensate for the unequal cathode-to-grid spacings, permitting the three guns to remain in substantially equal cutoff relation after warm-up.

Once established, the bias voltages do not change. Consequently, at initial turn on, when the grid No. 1-to-cathode spacings are substantially equal, the compensating bias voltages cause the cutoff relationship between the center and outer guns to be unequal. As the temperatures of the cathode assemblies increase, this inequality in cutoff diminishes until, at operating temperature equilibrium, equality is again attained.

Curve 50 depicts the plot of the cutoff voltage applied to the No. 1 grid with respect to the center cathode as a function of warm-up time. Likewise, curve 52 depicts the plot of the cutoff voltage with respect to one of the outer cathodes and curve 54 with respect to the other outer cathode.

Figure 2:
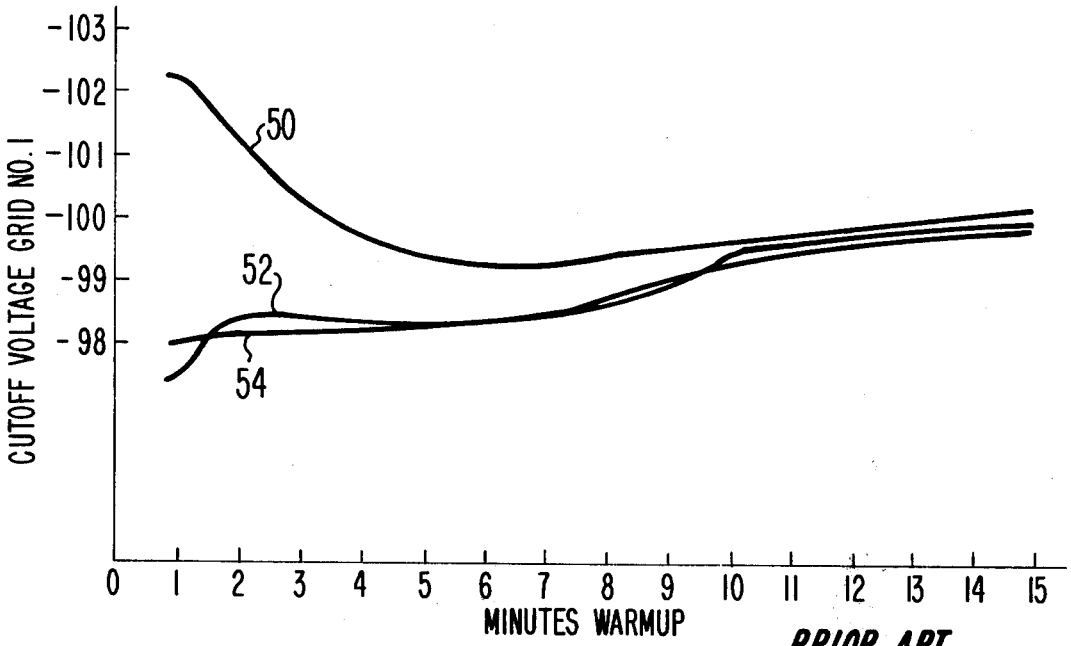
PRIOR ART Fig. 2
FIG. 2 is a graph showing a plot of cutoff voltage versus minutes warm-up for three electron guns in a prior art electron gun assembly.

At 1 minute after filament turn on, the cutoff voltage with respect to the center cathode, curve 50, is approximately 4.5 volts more negative than the cutoff voltages with respect to the outer cathodes, curves 52 and 54. Nine minutes later, at 10 minutes following filament turn on, the cutoff voltages are substantially equal. Using a sensitivity factor which has been empirically determined to be 14 volts per 0.025mm of cathode to No. 1 grid spacing for the type of electron gun assembly depicted in FIG. 1, the curves shown in FIG. 2 indicate that the center cathode has expanded approximately 0.008mm further from the grid No. 1 than did the outer cathodes during this nine minute period. As previously stated, since the period under consideration occurs following 1 minute after filament turn on, this change in spacing is due almost entirely to expansion of the cathode eyelets.

Warm-up of Present Invention Guns

To correct the cutoff tracking problem incurred during warm-up, the outer cathode eyelets 36 are made of a material having a higher thermal expansion coefficient than the material used to make the center cathode eyelet 24. This will permit the outer cathode eyelets 36 to expand at substantially the same rate as the center cathode eyelet 24, thereby maintaining the change in cathode to No. 1 grid spacing substantially equal from gun to gun. Since the change in spacings will remain approximately equal, the substantially equal cutoff relationships will be maintained during warm-up.

Temperature measurements of the outer eyelets 36, in a structure of the type shown in FIG. 1, indicate a 120° C rise in temperature during the 9 minute period encompassing 1 to 10 minutes after filament turn on. Since the center eyelet in the prior art structure expanded 0.008mm more than did the outer cathode eyelets, the outer eyelets are constructed of a material which expands approximately 0.008mm more than the prior art outer cathode eyelet material over a 120° C temperature rise. Note that it is also possible to choose a material for the center cathode eyelet which will decrease the center eyelet expansion by about 0.008mm, the primary consideration being that the materials be selected such that the temperature dependent variations in the spacings between the cathodes and the No. 1 grid remain substantially equal.

For an electron assembly 10 in which the center cathode eyelet 24 is constructed of type 52 metal, the preferred material for the outer cathode eyelets 36 is type 305 stainless steel, having a thermal expansion coefficient of 20 microns per meter per degree centigrade. In the prior art structure wherein all three cathode eyelets were constructed of type 52 metal having a thermal expansion coefficient of 9.5 microns per meter per degree centigrade, each outer cathode eyelet 36 would expand approximately 0.007mm over its nominal length of 6.35mm during the 1 to 10 minute period after filament turn on. Each outer cathode eyelet 36, constructed of type 305 stainless steel in accordance with the present invention, expands approximately 0.015mm over its nominal length of 6.35mm during the 1 to 10 minute period. As a result, the outer cathode eyelets of the present invention expand 0.015 – 0.007 or 0.008mm more than those of the prior art. This is the additional amount necessary to equal the expansion of the center cathode eyelet 24.

Figure 3:
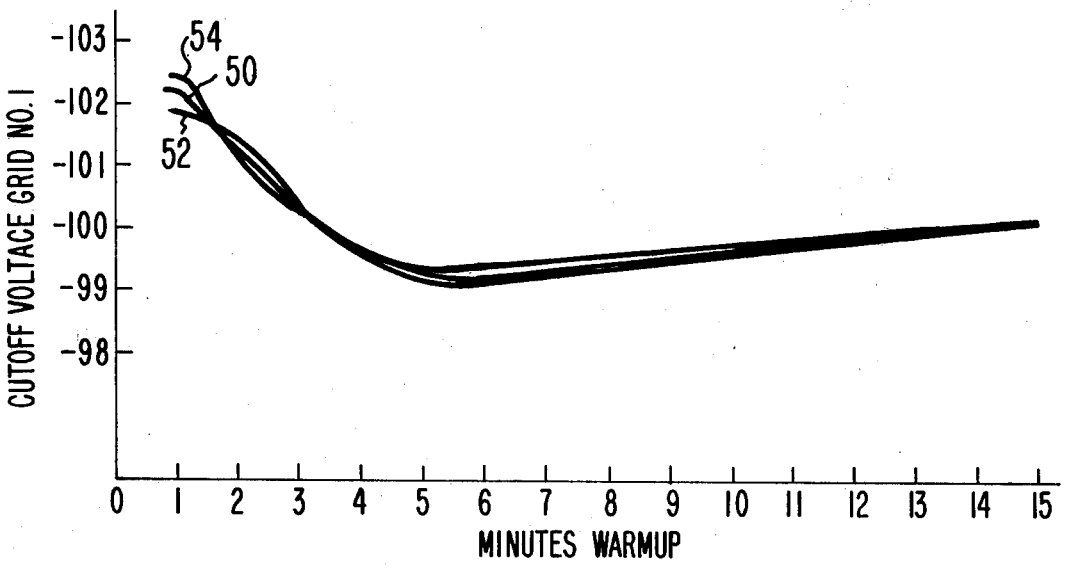
FIG. 3 is a graph showing a plot of cutoff voltage versus minutes warm-up for three electron guns in an electron gun assembly featuring temperature compensation in accordance with the present invention.

The warm-up characteristics depicted in FIG. 3 show the cutoff voltage vs. time of an electron gun assembly of the type shown in FIG. 1 employing a center cathode eyelet 24 of 52 metal and outer cathode eyelets 36 of type 305 stainless steel. Curve 50 in FIG. 3 is essentially the same as curve 50 in FIG. 2 since the material used for the center cathode eyelet remains unchanged from the prior art version. Curves 52 and 54 reflect the use of type 305 stainless steel for the outer cathode eyelets. These curves show that the No. 1 grid cutoff voltages, with respect to all three cathodes remain substantially equal, one to the other, from approximately 1 minute after filament turn on thereafter. This occurs because the material selected for the cathode eyelets cause the temperature induced variations in cathode to No. 1 grid spacings to remain substantially equal from cathode to cathode. This substantial equality of cutoff voltages during warm-up virtually eliminates the undesired dominance of the color characterized by the center cathode and permits white picture tracking to be maintained.

I claim:

1. In an electron gun assembly having a center cathode disposed between two outer cathodes in substantially co-planar relationship therewith, each of which is supported at a predetermined nominal spacing from a common control grid by a separate cathode support, wherein each spacing varies as a function of temperature of the respective cathode support and one of said cathode supports stabilizes at a higher operating temperature than the other cathode supports, the improvement comprising means for maintaining said temperature dependent variations in said spacings substantially equal from cathode to cathode.

2. An electron gun assembly in accordance with claim 1 wherein said one cathode support is of a first material and said other supports are of a second material, each of said materials having different thermal expansion coefficients which are selected such that expansion and contraction of each support is substantially equal to that of the other supports over their respective operating temperature ranges.

3. An electron gun assembly in accordance with claim 2 wherein each cathode support structure includes a cathode eyelet, the center cathode eyelet being formed of a material having a smaller thermal expansion coefficient than the outer cathode eyelets.

4. An electron gun assembly in accordance with claim 3 wherein said center cathode eyelet is formed of a material having a thermal expansion coefficient substantially equal to 9.5 microns per meter per degree centigrade and said outer cathode eyelets are each formed of a material having a thermal expansion coefficient substantially equal to 20.0 microns per meter per degree centigrade.

5. An electron gun assembly in accordance with claim 4 wherein said center cathode eyelet is formed of 52 metal and said outer cathode eyelets are each formed of type 305 stainless steel.

6. An electron gun assembly for a color television picture tube comprising:

a. a center cathode disposed between two outer cathodes, said cathodes being in a substantially coplanar relationship;

b. a support structure, including a cathode eyelet, for supporting said center cathode at a predetermined distance from a control grid, said center cathode eyelet being formed of a material having a thermal expansion coefficient substantially equal to 9.5 microns per meter per degree centigrade; and c. a support structure, including a cathode eyelet, for supporting each outer cathode at a predetermined distance from said control grid, each outer cathode eyelet being formed of a material having a thermal expansion coefficient substantially equal to 20.0 microns per meter per degree centigrade.

* * * * *